United States Patent [19]

Lange et al.

[11] Patent Number: 4,491,527

[45] Date of Patent: Jan. 1, 1985

[54] ESTER-HETEROCYCLE COMPOSITIONS USEFUL AS "LEAD PAINT" INHIBITORS IN LUBRICANTS

[75] Inventors: Richard M. Lange, Euclid; Jerry L. Rutter, Mentor, both of Ohio

[73] Assignee: The Lubrizol Corporation, Wickliffe, Ohio

[21] Appl. No.: 371,880

[22] Filed: Apr. 26, 1982

[51] Int. Cl.[3] ..... C10M 1/36

[52] U.S. Cl. ..... 252/51.5 A; 252/56 R; 548/269

[58] Field of Search ..... 252/51.5 A, 56 R; 548/269

[56] References Cited

U.S. PATENT DOCUMENTS

| | | | |
|---|---|---|---|
| 2,568,876 | 9/1951 | White et al. . | |
| 3,272,746 | 9/1966 | LeSuer et al. . | |
| 3,324,033 | 6/1967 | Knapp . | |
| 3,368,972 | 2/1968 | Otto . | |
| 3,397,146 | 8/1968 | Cupper et al. . | |
| 3,415,750 | 12/1968 | Anzenberger . | |
| 3,445,386 | 5/1969 | Otto et al. . | |
| 3,451,933 | 6/1969 | Leister . | |
| 3,519,564 | 7/1970 | Vogel . | |
| 3,522,179 | 7/1970 | LeSuer . | |
| 3,585,194 | 6/1971 | Leister . | |
| 3,679,585 | 7/1972 | Brook et al. . | |
| 3,732,334 | 5/1973 | Koch et al. . | |
| 3,836,470 | 9/1974 | Miller . | |
| 3,950,341 | 4/1976 | Okamoto et al. . | |
| 4,035,309 | 7/1977 | Brois . | |
| 4,053,426 | 10/1977 | Dairs et al. . | |
| 4,100,083 | 7/1978 | Murphy et al. . | |
| 4,113,639 | 9/1978 | Lonstrup et al. . | |
| 4,136,043 | 1/1979 | Davis | 252/51.5 A |
| 4,148,605 | 4/1979 | Andress | 252/51.5 A |
| 4,234,435 | 11/1980 | Meinhardt . | |
| 4,256,595 | 3/1981 | Sung et al. . | |
| 4,257,779 | 3/1981 | Sung et al. | 252/51.5 A |
| 4,263,015 | 4/1981 | Sung et al. | 252/51.5 A |
| 4,283,296 | 8/1981 | Nebzydoski et al. . | |
| 4,292,186 | 9/1981 | Chibnik et al. . | |

*Primary Examiner*—Jacqueline V. Howard

*Attorney, Agent, or Firm*—Raymond F. Keller; Denis A. Polyn; Walter C. Danison, Jr.

[57] ABSTRACT

Combinations of substituted carboxylic (especially succinic) acid esters and heterocyclic condensation products of said substituted carboxylic acids are useful in lubricants for inhibitors of "lead paint" deposition in internal combustion engines. Especially useful are compositions comprising a major proportion of a pentaerythritol ester of an alkenyl succinic acid in which the alkenyl group contains at least about 30 carbon atoms, and a minor proportion of a heterocyclic condensation product of said alkenyl succinic acid derived from a 5-membered ring heterocycle containing at least two ring hetero atoms separated by a single carbon atom, at least one of said hetero atoms being nitrogen.

43 Claims, No Drawings

ESTER-HETEROCYCLE COMPOSITIONS USEFUL AS "LEAD PAINT" INHIBITORS IN LUBRICANTS

This invention relates to new compositions of matter useful for the inhibition of "lead paint" deposition in lubricants, to additive concentrates and lubricants containing such compositions, and to a method for decreasing "lead paint" formation in internal combustion engines by the use of such compositions. In its broadest sense, the invention includes compositions comprising derivatives of substituted carboxylic acids in which the substituent is a substantially aliphatic, substantially saturated hydrocarbon-based radical containing at least about 30 aliphatic carbon atoms; said derivatives being the combination of:

(A) at least one ester of said substituted carboxylic acids in which all the alcohol moieties are derived from at least one mono- or polyhydroxyalkane; and (B) at least one heterocyclic condensation product of said substituted carboxylic acids containing at least one heterocyclic moiety which includes a 5- or 6-membered ring which contains at least two ring hetero atoms selected from the group consisting of oxygen, sulfur and nitrogen separated by a single carbon atom, at least one of said hetero atoms being nitrogen, and at least one carboxylic moiety; the carboxylic and heterocyclic moieties either being linked through an ester or amide linkage or being the same moiety in which said single carbon atom separating two ring hetero atoms corresponds to a carbonyl carbon atom of the substituted carboxylic acid.

A phenomenon sometimes encountered in internal combustion engine lubrication, particularly when the engine is powered by a fuel containing lead, is "lead paint" deposition. This is the deposition on engine surfaces of a thin film of finely divided lead-containing material; it is not alleviated by ordinary dispersants or detergents present in the lubricant.

A principal object of the present invention, therefore, is to provide novel compositions of matter useful as additives for lubricants.

A further object is to provide compositions which, when incorporated in an internal combustion engine lubricant, cause dispersion of insoluble impurities including "lead paint" during engine operation.

A still further object is to provide novel lubricants and a novel method for decreasing "lead paint" formation.

Other objects will in part be obvious and will in part appear hereinafter.

As will be apparent from the brief description of the invention hereinabove, the components of the compositions of this invention are derivatives of substituted carboxylic acids in which the substituent is a substantially aliphatic, substantially saturated hydrocarbon-based radical containing at least about 30 (preferably about 50 to about 750) aliphatic carbon atoms. As used herein, the term "hydrocarbon-based radical" denotes a radical having a carbon atom directly attached to the remainder of the molecule and having predominantly hydrocarbon character within the context of this invention. Such radicals include the following:

(1) Hydrocarbon radicals; that is, aliphatic radicals, aromatic- and alicyclic-substituted aliphatic radicals, and the like, of the type known to those skilled in the art.

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents; examples are halo, nitro, hydroxy, alkoxy, carbalkoxy and alkylthio.

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based radical.

The substituted carboxylic acids (and derivatives thereof including esters, amides and imides) are normally prepared by the alkylation of an unsaturated acid, or a derivative thereof such as an anhydride, ester, amide or imide, with a source of the desired hydrocarbon-based radical. Suitable unsaturated acids and derivatives thereof include acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid and 2-pentene-1,3,5-tricarboxylic acid. Particularly preferred are the unsaturated dicarboxylic acids and their derivatives, especially maleic acid, fumaric acid and maleic anhydride.

Suitable alkylating agents include homopolymers and interpolymers of polymerizable olefin monomers containing from about 2 to about 10 and usually from about 2 to about 6 carbon atoms, and polar substituent-containing derivatives thereof. Such polymers are substantially saturated (i.e., they contain no more than about 5% olefinic linkages) and substantially aliphatic (i.e., they contain at least about 80% and preferably at least about 95% by weight of units derived from aliphatic monoolefins). Illustrative monomers which may be used to produce such polymers are ethylene, propylene, 1-butene, 2-butene, isobutene, 1-octene and 1-decene. Any unsaturated units may be derived from conjugated dienes such as 1,3-butadiene and isoprene; nonconjugated dienes such as 1,4-hexadiene, 1,4-cyclohexadiene, 5-ethylidene-2-norbornene and 1,6-octadiene; and trienes such as 1-isopropylidene-3a,4,7,-7a-tetrahydroindene, 1-isopropylidenedicyclopentadiene and 2-(2-methylene-4-methyl-3-pentenyl)[2.2.1]bicyclo-5-heptene.

A first preferred class of polymers comprises those of terminal olefins such as propylene, 1-butene, isobutene and 1-hexene. Especially preferred within this class are polybutenes comprising predominantly isobutene units. A second preferred class comprises terpolymers of ethylene, a $C_{3-8}$ $\alpha$-monoolefin and a polyene selected from the group consisting of non-conjugated dienes (which are especially preferred) and trienes. Illustrative of these terpolymers is "Ortholeum 2052" manufactured by E. I. du Pont de Nemours & Company, which is a terpolymer containing about 48 mole percent ethylene groups, 48 mole percent propylene groups and 4 mole percent 1,4-hexadiene groups and having an inherent viscosity of 1.35 (8.2 grams of polymer in 100 ml. of carbon tetrachloride at 30° C.).

Methods for the preparation of the substituted carboxylic acids and derivatives thereof are well known in the art and need not be described in detail. Reference is made, for example, to U.S. Pat. Nos. 3,272,746; 3,522,179; and 4,234,435, which are incorporated by reference herein. The mole ratio of the polymer to the unsaturated acid or derivative thereof may be equal to, greater than or less than 1, depending on the type of product desired.

When the unsaturated acid or derivative thereof is maleic acid, fumaric acid or maleic anhydride, the alkylation product is a substituted succinic acid or derivative thereof. These substituted succinic acids and derivatives are particularly preferred for preparing the compositions of this invention.

Component A of the compositions of this invention is at least one ester of an above-described substituted carboxylic acid in which all the alcohol moieties are derived from at least one mono- or polyhydroxyalkane. Suitable succinic acid esters of this type are disclosed in the aforesaid U.S. Pat. Nos. 3,522,179 and 4,234,435. They may be prepared by known methods, by esterification of the substituted succinic acids or their derivatives with suitable mono- or polyhydroxyalkanes.

Suitable monohydroxyalkanes include methanol, ethanol, the propanols, butanols, pentanols, hexanols, heptanols, octanols, decanols, dodecanols, hexadecanols, etc., as well as the so-called fatty alcohols and mixtures thereof such as lauryl, myristyl, cetyl, stearyl and behenyl alcohols. Higher synthetic monohydric alcohols of the type formed by the Oxo process (e.g., 2-ethylhexanol), by the aldol condensation, or by organoaluminum-catalyzed oligomerization of α-olefins (especially ethylene), followed by oxidation, are also useful. These higher alcohols are discussed in detail under the title "Alcohols, Higher Aliphatic" in Kirk-Othmer, *Encyclopedia of Chemical Technology,* Third Edition, Vol. 1, pp. 716–754.

Useful polyhydroxyalkanes include ethylene, propylene, butylene, pentylene, hexylene and heptylene glycols wherein the hydroxy groups are separated by 2 carbon atoms, and tri-, tetra-, penta-, hexa- and heptamethylene glycols and hydrocarbon-substituted analogs thereof (e.g., 2-ethyl-1,3-trimethylene glycol, neopentyl glycol). They also include sugar alcohols of the general formula $HOCH_2(CHOH)_{1-5}CH_2OH$ such as glycerol, sorbitol, mannitol, etc. Such compounds are described under the title "Alcohols, Polyhydric" in *Encyclopedia of Chemical Technology,* Vol. 1, pp. 754–789.

The preferred alcohols are the polyhydroxyalkanes containing from about 2 to about 10 carbon atoms and usually from about 3 to about 6 hydroxy groups; examples are glycerol, pentaerythritol, sorbitol, mannitol, trimethylolethane and trimethylolpropane. Pentaerythritol is especially preferred.

The esters suitable for use as component A include neutral esters (i.e., those prepared by esterification of all acidic moieties in the substituted carboxylic acid or derivative thereof) and acidic esters (i.e., those containing some unreacted acidic moieties). Compositions suitable as component A are known to serve as dispersant additives in lubricants, and they ordinarily serve as such in the lubricating compositions of this invention.

Component B of the compositions of this invention is characterized by the presence of at least one heterocyclic moiety including a 5- or 6-membered ring which contains at least two ring hetero atoms separated by a single carbon atom. The ring hetero atoms may be oxygen, sulfur and nitrogen, with at least one thereof being nitrogen.

A large number of heterocyclic moieties are suitable; they are listed in *The Ring Index,* Second Edition (1960), pp. 8–13, 16–17, 22–27 and 30–32. Illustrative 5-membered ring heterocyclic moieties include the imidazoles, oxazoles, thiazoles, triazoles, oxadiazoles, dioxazoles, thiadiazoles, dithiazoles, oxathiazoles, oxatriazoles and thiatriazoles. Illustrative 6-membered ring heterocyclic moieties include the pyrimidines, oxazines, thiazines, triazines, oxadiazines, dioxazines, thiadiazines, dithiazines, oxathiazines, tetrazines, oxatriazines, dioxadiazines, thiatriazines, dithiadiazines and oxathiadiazines. Both unsubstituted and substituted heterocyclic moieties are suitable.

Most often, the heterocyclic moiety contains a maximum of 3 ring hetero atoms and a 5-membered ring. It is preferably a triazole or thiadiazole ring, and most desirably a 1,2,4-triazole ring.

The carboxylic and heterocyclic moieties of component B may be linked through at least one ester or amide (including imide) linkage which may also contain other atoms. This linkage may be formed, for example, by the known reaction of the substituted carboxylic acid with a suitable hydroxy or reactive amino group-containing heterocycle such as an aminotriazole (e.g., 3-amino-1,2,4-triazole) or an imidazole-alkylene oxide condensation product.

Alternatively, the carboxylic and heterocyclic moieties may be the same moiety, with the single carbon atom separating two ring hetero atoms corresponding to a carbonyl carbon atom of the substituted carboxylic acid. This is the case when the substituted carboxylic acid is reacted with an acyclic heterocycle precursor which cyclizes with the carboxylic acid group to form a heterocyclic compound. Illustrative acyclic heterocycle precursors which may react with an acid or acid derivative group to form such heterocycles are aminoguanidine and salts thereof, semicarbazide, thiosemicarbazide, carbohydrazide and thiocarbohydrazide, as well as salts thereof such as aminoguanidine bicarbonate. The cyclization reactions which take place are exemplified by those disclosed in *Angewandte Chemie,* International Edition, 2, 459 (1963); *Organic Syntheses,* Coll. Vol. III, 95 (1955); and *Chemical Abstracts,* 57, 804i (1962), which are incorporated by reference for such disclosures. They may be illustrated as follows:

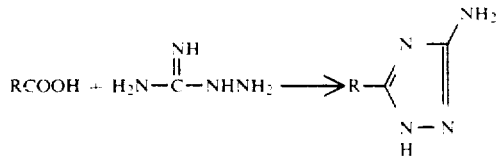

aminoguanidine 3-aminotriazole

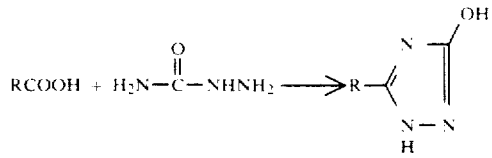

semicarbazide 3-hydroxytriazole

-continued

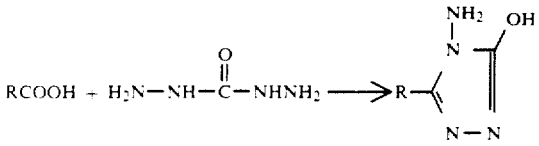

carbohydrazide 3-hydroxy-4-amino-triazole

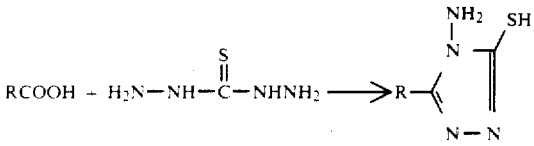

thiocarbohydrazide 3-mercapto-4-amine-triazole

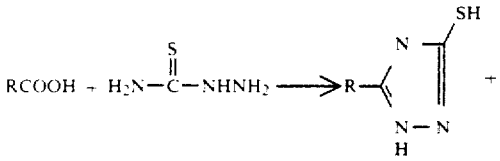

thiosemicarbazide 3-mercaptotriazole

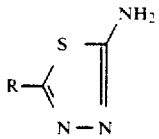

2-aminothia-diazole

Various other reactions may also form heterocycles useful as component B. For example, the heterocycle or acyclic heterocycle precursor may react with an acid derivative such as an anhydride or ester. Also, a reaction may take place between an acid or acid derivative group and an active hydrogen-containing atom on the heterocycle formed from the acyclic heterocycle precursor; e.g., the 3-amino or ring NH group of a 3-amino-triazole. In that case, component B will contain more carboxylic than heterocyclic moieties.

It is frequently convenient to prepare the compositions of this invention by the reaction of a suitable heterocycle or acyclic heterocycle precursor with a substituted succinic acid ester containing some free carboxylic acid groups. The free acid groups in such an ester may occur either in free substituted carboxylic acid present therein by reason of incomplete esterification, or in an acidic ester by reason of esterification of only one of the two acid groups of a polycarboxylic acid such as a substituted succinic acid. To the extent the latter is the case, the reaction forming component B involves free carboxylic acid groups present in component A. Thus, to this extent components A and B may be the same. It is also possible for at least some of component B to be formed by displacement of ester groups in component A by the heterocycle or acyclic heterocycle precursor.

It is possible that the reaction of a carboxylic acid or derivative thereof with an acyclic heterocycle precursor may, under certain conditions, afford substantial proportions of a non-heterocyclic product; for example:

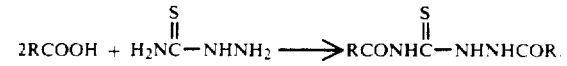

Therefore, the present invention includes compositions in which component B is at least one condensation product of said substituted carboxylic acids with an acyclic heterocycle precursor, regardless of the molecular structure of said condensation product.

In general, the compositions of this invention will contain a major proportion, typically about 90% to about 99.9% by number, of non-heterocyclic ester (component A) radicals and a minor proportion, typically about 0.1% to about 10%, of heterocycle or other condensation product (component B) radicals.

The preferred compositions of this invention are those having a maximum total acid number (as determined by ASTM procedure D664 or D974) of about 10. Such compositions may be prepared by reacting an ester containing free carboxylic acid groups with a heterocycle or acyclic heterocycle precursor until the total acid number has been suitably reduced.

The invention is illustrated by the following examples. Examples 1-2 illustrate the preparation of compositions suitable for use as component B; the remaining examples illustrate the preparation of the compositions of this invention from esters containing free carboxylic acid groups. All parts and percentages are by weight unless otherwise indicated.

EXAMPLE 1

A solution of 272 parts (4 moles) of imidazole in 532 parts of ethylene glycol dimethyl ether was heated to 35° C. and 232 parts (4 moles) of propylene oxide was added over 4½ hours at 35°-40° C. under nitrogen, with stirring. The temperature was increased until the reflux point was reached and heating was continued for about 5 hours. Volatiles, including water, were then removed by distillation to yield an imidazole-propylene oxide condensation product as the residue.

A substituted succinic acid was prepared by a method similar to that described in Example 2 of U.S. Pat. No. 4,234,435, by the reaction of 106 parts of maleic anhydride with 1,000 parts of a polybutene comprising predominantly isobutene units and having a number average molecular weight of about 2,000, in the presence of 90 parts of chlorine. To a solution of 1,085 parts of the substituted succinic acid in 546 parts of mineral oil was added over 10 minutes, with stirring, 204 parts of the imidazole-propylene oxide condensation product. The mixture was heated at 90°-210° C. under nitrogen, with stirring, for about 22½ hours as volatiles were removed by distillation. An additional 494 parts of mineral oil was added to yield a 55% solution in mineral oil of the desired product; it contained 1.51% nitrogen and had a total acid number of 5.18.

EXAMPLE 2

Urea, 273 parts (4.55 moles), was added 1½ hours at 90°-130° C., with stirring, to 935 parts (9.1 moles) of diethylene triamine. The mixture was heated to 203° C. over 4½ hours and vacuum distilled; the desired condensation product, aminoethylimidazolidinone, was obtained at 165°-175° C./0.65 torr.

A solution of 1,809 parts of the substituted succinic anhydride of Example 1 in 1,305 parts of mineral oil was heated to 140° C. and 176 parts of aminoethylimidazolidinone was added over 1 hour, with stirring. The mixture was heated to 160° C. for 4 hours, under nitrogen, and was then filtered. The filtrate was a 60% solution in mineral oil of the desired product; it contained 1.57% nitrogen and had a total acid number of 2.44.

EXAMPLE 3

A pentaerythritol ester of polybutenyl succinic acid was prepared by the reaction in 907 parts of mineral oil of 109 parts of pentaerythritol with 1,000 parts of polybutenyl succinic anhydride, prepared by the reaction of maleic anhydride with a polybutene comprising predominantly isobutene units and having a number average molecular weight of about 1,000. The resulting ester had a total acid number of 10.

A mixture of 6,700 grams of the pentaerythritol ester, 100.5 grams of aminoguanidine bicarbonate and 600 ml. of toluene was heated under reflux as volatiles were removed by distillation. After removal of volatiles was complete, the mixture was vacuum stripped and filtered through cloth. The filtrate was a 55% solution in mineral oil of the desired ester-triazole mixture; it contained 0.39% nitrogen and had a total acid number of 2.5.

EXAMPLES 4–5

Following the procedure of Example 3, products were prepared by the reaction of 1,000 grams of the pentaerythritol ester with 22.5 and 30 grams, respectively, of aminoguanidine bicarbonate. The products respectively contained 0.95 and 0.80% nitrogen and had total acid numbers of 0.5 and 3.9.

EXAMPLE 6

An ester was prepared by the reaction of 2,284 grams of the substituted succinic acid of Example 1 with 351 grams of trimethylolpropane in 1,400 grams of mineral oil and 100 ml. of toluene, followed by removal of volatiles by vacuum distillation. The 65% solution in mineral oil of the ester had a total acid number of 7.2.

Following the procedure of Example 3, 1,000 grams of the trimethylolpropane ester was reacted with 20 grams of aminoguanidine bicarbonate. The product was the desired 65% solution in mineral oil of the ester-triazole mixture; it contained 0.73% nitrogen and had a total acid number approximating 0.

EXAMPLE 7

Following the procedure of Example 3, 1,000 grams of the pentaerythritol ester of Example 3 was reacted with 15 grams of thiosemicarbazide in 100 ml. of toluene. The product, a 55% solution in mineral oil, contained 0.64% nitrogen and had a total acid number of 7.6.

EXAMPLE 8

Following the procedure of Example 3, a reaction product of 1,000 grams of the pentaerythritol ester with 7.5 grams of aminoguanidine bicarbonate and 7.5 grams of thiosemicarbazide was obtained as a 55% mineral oil solution. It contained 0.71% nitrogen and had a total acid number of 4.0.

EXAMPLE 9

Following the procedure of Example 3, a reaction product of 1,000 parts of the trimethylolpropane ester of Example 6 with 20 parts of thiosemicarbazide was obtained as a 65% solution in mineral oil. It contained 0.75% nitrogen and had a total acid number of 6.0.

EXAMPLE 10

Following the procedure of Example 3, a reaction product of 1,000 parts of the pentaerythritol ester with 15 parts of carbohydrazide was obtained as a 55% solution in mineral oil. It contained 0.65% nitrogen and had a total acid number of 1.8.

EXAMPLE 11

The procedure of Example 10 is repeated, substituting 18 parts of thiocarbohydrazide for the carbohydrazide. A similar product is obtained.

EXAMPLE 12

A toluene solution of 1,000 parts of the pentaerythritol ester of Example 3 and 7.5 parts of aminoguanidine bicarbonate was heated under reflux at about 180° C. until all volatiles had been removed by distillation. The temperature was then reduced to 100° C. and 7.5 parts of carbohydrazide were added. Distillation was resumed, followed by vacuum stripping and filtration. The filtrate was a 55% solution in mineral oil of the desired product; it contained 0.68% nitrogen and had a total acid number of 1.2.

EXAMPLE 13

Following the procedure of Example 3, 1,000 grams of the pentaerythritol ester was reacted with 15 grams of aminotriazole to yield a 55% solution in mineral oil of the desired product. It contained 1.01% nitrogen and had a total acid number of 6.6.

EXAMPLE 14

Following the procedure of Example 3, a reaction product of 1,000 parts of the pentaerythritol ester with 15 parts of imidazole was obtained as a 55% solution in mineral oil. It contained 0.44% nitrogen and had a total acid number of 2.1.

As previously indicated, the compositions of this invention are useful as additives for lubricants, in which they function primarily as inhibitors of "lead paint" formation. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. The compositions can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of this invention.

Natural oils include liquid petroleum oils and solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)]; alkylbenzenes [e.g., dodecylbenzenes, tetradecylbenzenes, dinonylbenzenes, di(2-ethylhexyl)benzenes]; polyphenyls (e.g., biphenyls, terphenyls, alkylated polyphenols); and alkylated diphenyl ethers and alkylated diphenyl sulfides and the derivarives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono-and polycarboxylic esters thereof, for example, the acetic acid esters, mixed $C_3$–$C_8$ fatty acid esters and $C_{13}$ Oxo acid diester Of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, furmaric acid, adipic acid, linoleic acid dimer, malonic acid, alkyl malonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Generally, the lubricants of the present invention contain an amount of the composition of this invention sufficient to disperse insoluble materials and inhibit "lead paint" deposition. Normally this amount will be about 0.1% to about 10.0%, preferably about 1% to about 5%, by weight.

The invention also contemplates the use of other additives in combination with the compositions of this invention. Such additives include, for example, auxiliary detergents and dispersants of the ash-producing or ashless type, corrosion- and oxidation-inhibiting agents, pour point depressing agents, extreme pressure agents, color stabilizers and anti-foam agents.

The ash-producing detergents are exemplified by oil-soluble neutral and basic salts of alkali or alkaline earth metals with sulfonic acids, carboxylic acids, and organic phosphorus acids characterized by at least one direct carbon-to-phosphorus linkage including those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenols, thiophenol, sulfurized alkylphenols, and condensation products of formaldehyde with phenolic substances; alcohols such as methanol, 2-propanol, octyl alcohol, Cellosolve, Carbitol, ethylene glycol, stearyl alcohol and cyclohexyl alcohol; and amines such as aniline, phenylenediamine, phenothiazine, phenyl-$\beta$-naphthylamine and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Auxiliary ashless detergents and dispersants are so called despite the fact that, depending on its constitution, the dispersant may upon combustion yield a nonvolatile material such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen-containing compounds such as amines, organic hydroxy compounds such as phenols and alcohols, and/or basic inorganic materials. Examples of these "carboxylic dispersants" are described in many U.S. patents including U.S. Pat. No. 3,272,746 and the patents incorporated by reference hereinabove.

(2) Reaction products of relatively high molecular weight aliphatic or alicyclic halides with amines, preferably polyalkylene polyamines. These may be characterized as "amine dispersants" and examples thereof are described for example, in U.S. Pat. Nos. 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in U.S. Pat. Nos. 3,368,972; 3,413,347; and 3,980,569 are illustrative.

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in a number of U.S. patents.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in U.S. Pat. Nos. 3,329,658; 3,449,250; 3,519,565; 3,666,730; 3,687,849; and 3,702,300.

All of the above-noted patents are incorporated by reference herein for their disclosures of ashless dispersants.

Extreme pressure agents and corrosion- and oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl oleate, sulfurized alkylphenols, sulfurized dipentene, and sulfurized terpenes; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite and diisobutylsubstituted phenyl phosphite; metal thiocarbamates such as zinc dioctyldithiocarbamate and barium heptylphenyl dithiocarbamate; Group II metal phosphorodithioates such as zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The compositions of this invention can be added directly to the lubricant. Preferably, however, they are diluted with a substantially inert, normally liquid organic diluent such as mineral oil, naphtha, benzene, toluene or xylene, to form an additive concentrate. These concentrates usually contain from about 20% to about 90% by weight of the composition of this invention and may contain, in addition, one or more other additives known in the art or described hereinabove.

Illustrative lubricating compositions of this invention are listed in the following table. All amounts, except those for mineral oil and the products of Examples 3 and 13, are exclusive of mineral oil used as diluent.

| | Parts by weight Lubricant | | | |
|---|---|---|---|---|
| Ingredient | A | B | C | D |
| Mineral oil | 86.63 | 90.82 | 85.13 | 85.13 |
| Product of Example 3 | 4.20 | 4.95 | — | 5.00 |
| Product of Example 13 | — | — | 5.00 | — |
| Basic calcium petroleum sulfonate | 0.74 | 1.07 | 0.75 | 0.75 |
| Basic magnesium petroleum sulfonate | — | 0.21 | 0.25 | 0.25 |
| Basic sodium petroleum sulfonate | — | — | 0.16 | 0.16 |
| Basic calcium salt of alkylphenol sulfide | — | — | 0.62 | 0.62 |
| Basic magnesium alkylphenate | — | 0.66 | — | — |
| Alkylphenol sulfide | — | 1.18 | — | — |
| Sulfurized alkyl cyclohexenecarboxylate | 0.25 | — | — | — |
| Fatty amide | — | — | 0.20 | 0.20 |
| Alkylated diphenylamine | — | — | 0.25 | 0.25 |
| zinc dialkylphosphorodithioate | 1.18 | 1.11 | 1.14 | 1.14 |
| Polymeric viscosity modifier | 7.00 | — | 6.50 | 6.50 |
| Silicone anti-foam agent | 0.006 | 0.01 | 0.005 | 0.005 |

What is claimed is:

1. A composition comprising derivatives of substituted carboxylic acids in which the substituent is a substantially aliphatic, substantially saturated hydrocarbon-based radical containing at least about 30 aliphatic carbon atoms; said derivatives being at least one heterocyclic condensation product of at least one free carboxylic acid containing ester of said substituted carboxylic acids in which all alcohol moieties are derived from at least one mono- or polyhydroxyalkane; wherein said heterocyclic condensation product contains at least one heterocyclic moiety which includes a 5- or 6-membered ring which contains at least two ring hetero atoms selected from the group consisting of oxygen, sulfur and nitrogen separated by a single carbon atom, at least one of said hetero atoms being nitrogen, and at least one carboxylic moiety; the carboxylic and heterocyclic moieties either being linked through an ester or amide linkage or being the same moiety in which said single carbon atom separating two ring hetero atoms corresponds to a carbonyl carbon atom of the substituted carboxylic acid.

2. A composition according to claim 1 wherein the substituted carboxylic acid is a substituted succinic acid.

3. A composition according to claim 2 which contains about 90% to about 99.9% by number of non-heterocyclic ester radicals and about 0.1% to about 10% of heterocycle radicals.

4. A composition according to claim 3 wherein the hydrocarbon-based radical contains about 50 to about 750 aliphatic carbon atoms.

5. A composition according to claim 4 wherein said heterocyclic moiety contains a maximum of 3 ring hetero atoms.

6. A composition according to claim 5 wherein said heterocyclic moiety is a 5 membered ring.

7. A composition according to claim 6 wherein the substituent on the substituted succinic acid is derived from a polymer of at least one olefin containing from 2 to about 10 carbon atoms.

8. A composition according to claim 7 wherein the olefin polymer is a polybutene containing predominantly isobutene units.

9. A composition according to claim 6 wherein said heterocyclic moiety is a 1,2,4-triazole ring.

10. A composition according to claim 9 wherein the substituent on the substituted succinic acid is derived from a polymer of at least one olefin containing from 2 to about 10 carbon atoms.

11. A composition according to claim 10 wherein the olefin polymer is a polybutene containing predominantly isobutene units.

12. A composition according to claim 11 wherein said heterocyclic moiety is a 3-aminotriazole ring.

13. A composition according to claim 11 wherein said heterocyclic moiety is a 3-hydroxytriazole ring.

14. A composition according to claim 11 wherein said heterocyclic moiety is a 3-hydroxy-or-3-mercapto-4-aminotriazole ring.

15. A composition according to claim 8 wherein said heterocyclic moiety is at least one of 3-mercaptotriazole and 2-aminothiadiazole rings.

16. A composition according to any of claims 1–15 wherein said alcohol moieties are derived from at least one polyhydroxyalkane containing 2 to about 10 carbon atoms.

17. A composition according to claim 16 wherein the polyhydroxyalkane is pentaerythritol.

18. A composition according to claim 17 wherein said carboxylic and heterocyclic moieties are the same moiety.

19. A composition according to claim 18 which has a maximum total acid number of about 10.

20. A composition according to claim 20 wherein the substituted carboxylic acid is a substituted succinic acid.

21. A composition comprising derivatives of substituted carboxylic acids in which the substituent is a substantially aliphatic, substantially saturated hydrocarbon-based radical containing at least about 30 aliphatic carbon atoms; said derivatives being at least one condensation product of at least one free carboxylic acid containing ester of said substituted carboxylic acids in which all the alcohol moieties are derived from at least one mono- or polyhydroxyalkane, with an acyclic heterocycle precursor.

22. A composition according to claim 21 which contains about 90% to about 99.9% by number of non-heterocyclic ester radicals and about 0.1% to about 10% of said condensation product radicals.

23. A composition according to claim 22 wherein the hydrocarbon-based radical contains about 50 to about 750 aliphatic carbon atoms.

24. A composition according to claim 23 wherein the substituent on the substituted succinic acid is derived from a polymer of at least one olefin containing from 2 to about 10 carbon atoms.

25. A composition according to claim 24 wherein the olefin polymer is a polybutene containing predominantly isobutene units.

26. A composition according to claim 25 wherein the acyclic heterocycle precursor is aminoguanidine or a salt thereof.

27. A composition according to claim 25 wherein the acyclic heterocycle precursor is semicarbazide, thiosemicarbazide or a salt thereof.

28. A composition according to claim 25 wherein the acyclic heterocycle precursor is carbohydrazide, thiocarbohydrazide or a salt thereof.

29. A compostiion according to any of claims 20–28 wherein said alcohol moieties are derived from at least one polyhydroxyalkane containing 2 to about 10 carbon atoms.

30. A composition according to claim 29 wherein the polyhydroxyalkane is pentaerythritol.

31. A composition according to claim 30 which a maximum total acid number of about 10.

32. An additive concentrate comprising a substantially inert, normally liquid organic diluent and about 20% to about 90% by weight of a composition according to claim 1, 2, 4, 6, 9, 12, 20, 21, 23, 25 or 26.

33. An additive concentrate comprising a substantially inert, normally liquid organic diluent and about 20% to about 90% by weight of a composition according to claim 17.

34. An additive concentrate comprising a substantially inert, normally liquid organic diluent and about 20% to about 90% by weight of a composition according to claim 18.

35. An additive concentrate comprising a substantially inert, normally liquid organic diluent and about 20% to about 90% by weight of a composition according to claim 30.

36. A lubricating composition comprising a major amount of a lubricating oil and a minor amount of a composition according to claim 1, 2, 4, 6, 9, 12, 20, 23, 25 or 26.

37. A lubricating composition comprising a major amount of a lubricating oil and a minor amount of a composition according to claim 17.

38. A lubricating composition comprising a major amount of a lubricating oil and a minor amount of a composition according to claim 18.

39. A lubricating composition comprising a major amount of a lubricating oil and a minor amount of a composition according to claim 30.

40. A method for inhibiting "lead paint" deposition in an internal combustion engine which comprises lubricating said engine during operation with a lubricating composition according to claim 36.

41. A method for inhibiting "lead paint" deposition in an internal combustion engine which comprises lubricating said engine during operation with a lubricating composition according to claim 37.

42. A method for inhibiting "lead paint" deposition in an internal combustion engine which comprises lubricating said engine during operation with a lubricating composition according to claim 38.

43. A method for inhibiting "lead paint" deposition in an internal combustion engine which comprises lubricating said engine during operation with a lubricating composition according to claim 39.

* * * * *